United States Patent [19]

Lee

[11] 4,371,331

[45] Feb. 1, 1983

[54] CIGARETTE LIGHTER WITH FLIP-OUT WINDSHIELD

[76] Inventor: Kuo-Cheng Lee, No. 18-2, Yu-Lo La., Pei-Tah Rd., Wen-Hua Li, Hsin Chu, Taiwan

[21] Appl. No.: 177,841

[22] Filed: Aug. 14, 1980

[30] Foreign Application Priority Data

Mar. 12, 1980 [TW] Taiwan ..... 6921134

[51] Int. Cl.[3] ..... F23Q 25/00

[52] U.S. Cl. ..... 431/151

[58] Field of Search ..... 431/151, 310

[56] References Cited

U.S. PATENT DOCUMENTS 2,763,129 9/1956 Kohn et al. ..... 431/151

FOREIGN PATENT DOCUMENTS 333329 8/1930 United Kingdom ..... 431/151

*Primary Examiner*—Carroll B. Dority, Jr.

*Attorney, Agent, or Firm*—Robert E. Burns; Emmanuel J. Lobato; Bruce L. Adams

[57] ABSTRACT

A cigarette lighter built with a flip-out windshield having one corner edge hinged to the lighter body. The windshield is normally folded in and concealed in the lighter body when not in use, and is then flipped out to protect the flame from wind when in use.

5 Claims, 13 Drawing Figures

CIGARETTE LIGHTER WITH FLIP-OUT WINDSHIELD

BACKGROUND OF THE INVENTION

Conventional cigarette lighters are usually built with a body and a cap hinged to the body. The cap serves to protect the flaming device from contact with other articles when carried in one's pocket, but does not protect the flame from wind when in use.

Some known constructions provide a windshield fixed around the flaming device, but such fixed windshields do not protect the flame from relatively strong wind because of size or height limitations. It can be improved by enlarging the size or height of the fixed windshield; however, this also undesirably enlarges the overall size of the cigarette lighter.

In view of the aforesaid problems, this invention offers a novel construction of cigarette lighter with a flip-out windshield which can be flipped out to protect the flame from relatively strong wind when in use, and folded in to be concealed in the lighter body when not in use without undesirably enlarging the overall size of the cigarette lighter.

Therefore, it is the main object of this invention to provide a cigarette lighter with a flip-out winshield which can, when flipped out in upright position, be used for protecting the flame from wind and also can be folded to be concealed in the lighter body when not in use.

It is another object of this invention to provide a cigarette lighter with a flip-out windshield that is also used in place of the cigarette lighter cap.

DETAILED DESCRIPTION OF THE INVENTION

The features, objects and construction of the cigarette lighter of this invention will be more fully understood from the following description taken in conjunction with the accompanying drawings, in which.

Figure 10:
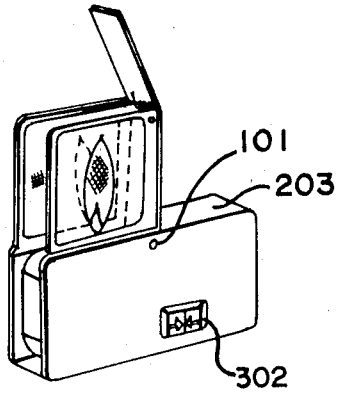
Figure 11:
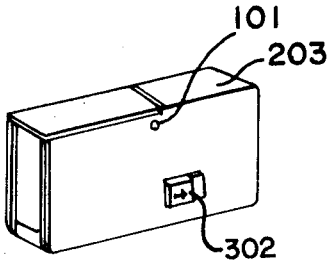

FIGS. 10, and 11 show the fourth embodiment of the cigarette lighter with flip-out windshield of this invention.

Figure 12:
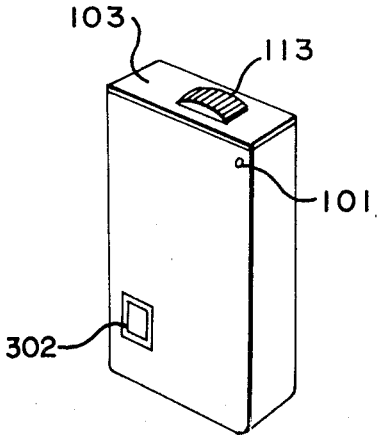
Figure 13:
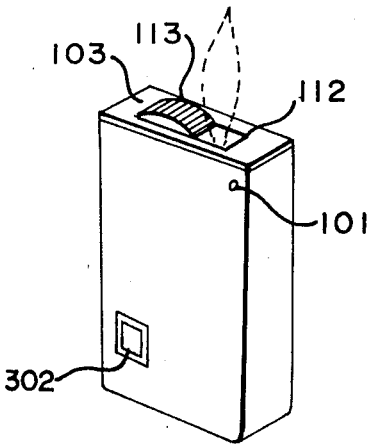

FIGS. 12 and 13 show the fifth embodiment of the cigarette lighter flip-out windshield of this invention.

Figure 1:
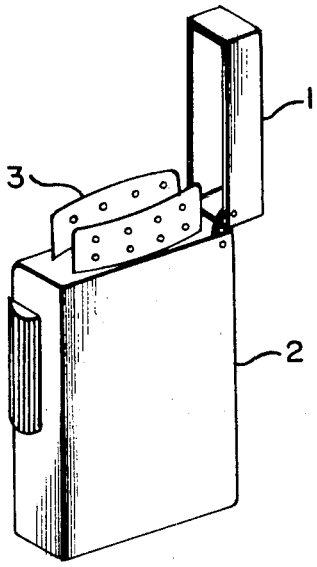
FIG. 1 PRIOR ART
FIG. 1 is an oblique, perspective view of a conventional cigarette lighter with fixed windshield or guard.

A conventional cigarette lighter having a fixed windshield is shown in FIG. 1. In the drawing, 1 is the cap, 2 is the lighter body, 3 is the fixed windshield. Such a windshield will not protect the flame from relatively strong wind and one has to use his hand or find another proper means to shield the cigarette lighter when lighting a cigarette in the wind.

The first embodiment of the cigarette lighter with flip-out windshield of this invention is shown in FIGS. 2 through 7.

Figure 2:
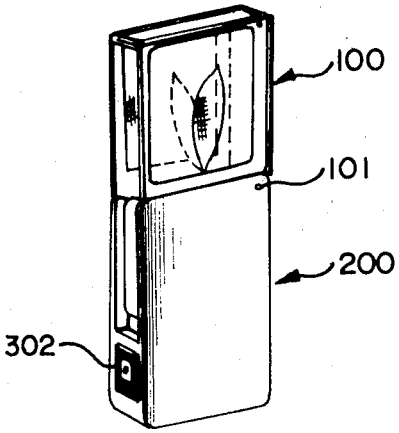
FIG. 2 is an oblique, perspective view of the first embodiment of the cigarette lighter with flip-out windshield of this invention, with flip-out windshield in upright position.
Figure 4:
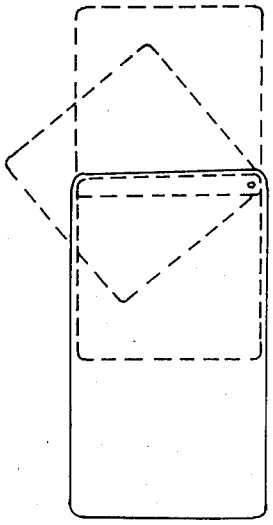
FIG. 4 is a schematic drawing showing the movement of the flip-out windshield of the cigarette lighter according to this invention.
Figure 3:
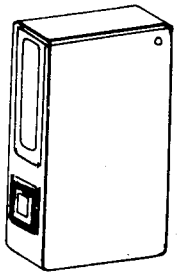
FIG. 3 is an oblique, perspective view of the first embodiment of this invention as shown in FIG. 2, with the flip-out windshield folded into the lighter body.

As shown in FIG. 2, the cigarette lighter with flip-out windshield of this invention comprises a cigarette lighter body 200 and a windshield 100 hinged at one corner onto the lighter body 200. The windshield 100 is capable of rotating around the hinge pin 101 to the upright position as shown in FIG. 2 and to the folded in position as shown in FIG. 3. Its movement is shown in FIG. 4.

Figure 5:
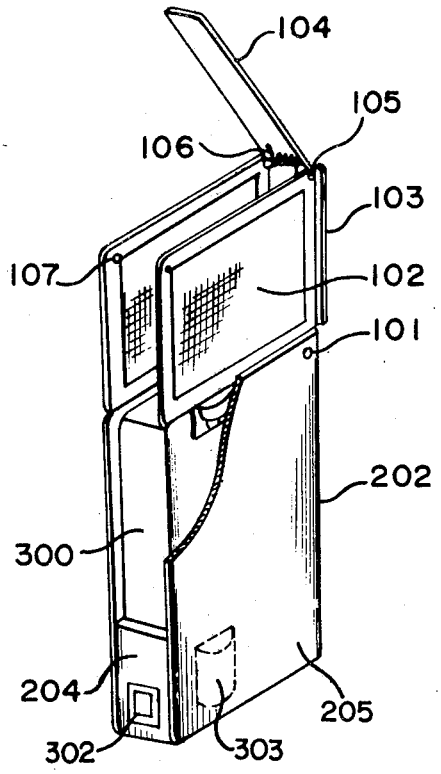
FIG. 5 is an oblique, perspective view of the first embodiment of this invention as shown in FIG. 2, with the casing of the lighter body partial cut away.

Referring now to FIG. 5, the windshield 100 comprises two symmetrically opposing side panels 102, a rear panel 103 and a top lid 104, each side panel 102 having a rectangular metallic frame with fine mesh metallic wire screen stretched therein and being fixedly connected to the rear panel 103, the top lid 104 being hinged at its rear end to the rear, upper corner of the side panels with hinge pin 105 provided with a coil spring 106 which urges the top lid to swing upwards. The front upper corners of the side panels 102 are provided with a projections 107 for holding the top lid 104 in place when the top lid 104 is pushed down to snap therein.

The cigarette lighter body 200 comprises a casing 202 having two side panels 205, a front panel 204, a rear panel 203 (FIG. 6) and a bottom panel 206 (FIG. 6), in which a conventional lighting device 300 is accommodated. An adequate clearance between the side panels and the lighting device 300 is maintained so that the side panels 102 of the windshield can move in and out freely. The lighting device 300 is provided with a flaming tip 301 on top slightly below the upper edge 207 of the casing 202.

The fuel adjusting screw 201 is located in the bottom side of the lighter body 200. In the drawing, a cigarette lighter with electronic or electromagnetic lighting device is shown, in which the lighting (igniting) button 302 is provided at the lower part of the front panel 204. In case of a lighting device with a lighting stone, the lighting wheel 303, as shown with imaginary lines in FIG. 5, can be arranged at the lower part of one side of the lighter body.

Figure 6:
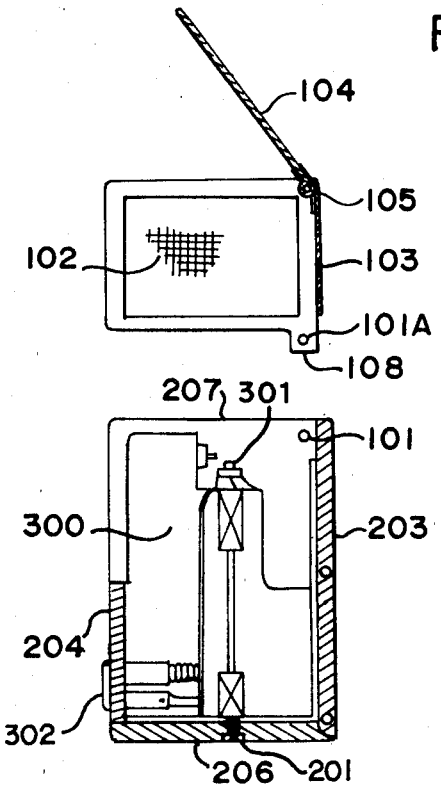
FIG. 6 is a vertical, longitudinal, cross sectional view of the first embodiment of this invention as shown in FIG. 2, with the flip-out windshield dismantled from the lighter body, and only a part of the internal arrangement is shown.

Referring to FIG. 6, the rear, lower corner of each side panel 102 of the windshield 100 is provided with a generally rectangular cam-shaped projection 108 with a hole 101A in which the hinge pin 101 will be inserted, said projection 108 being arranged to abut on the inner surface of the upper end portion of the rear panel 203 of the casing 202, said rear panel 203 being fixed at a middle portion and at the lower end portion thus having a resiliency in upper portion thereof to hold the windshield in a folded in or upright position.

The width of the rear panel 103 of the windshield 100 is made the same width as the casing 202 so that it rides flash with the upper edge of the casing 202 when the windshield is folded in.

With the top lid 104 pushed down to snap in between the two side panels 102, the windshield 100 can be folded in the casing 202 as shown in FIG. 2.

Figure 7:
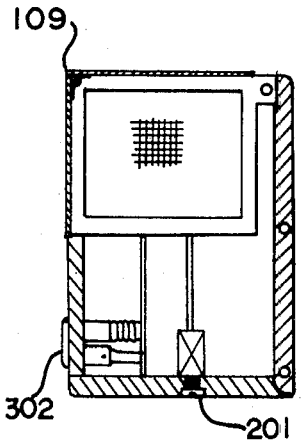
FIG. 7, is a side view of the first embodiment of this invention as shown in FIG. 2, with a side panel of the casing of the lighter body removed and the flip-out windshield folded in the cigarette lighter body.

To use the cigarette lighter with the flip-out windshield, simply push up the corner portion 109 as shown in FIG. 7. The process is the same as opening up the cap of a conventional cigarette lighter. As soon as the windshield is raised to its upright position, push up the front end of the top lid 104, then one can proceed to strike the lighter in the wind. In the extremely windy circumstances one may leave the top lid 104 closed when lighting a cigarette but will need to tilt the cigarette lighter slightly for easier access to the flame through the opening at the front side of the windshield.

Figure 8:
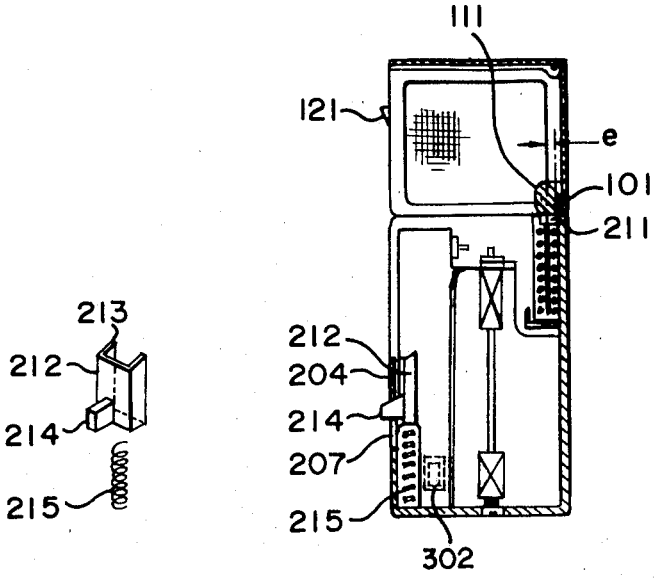
FIG. 8, is a vertical, longitudinal, cross sectional view of the second embodiment of the cigarette lighter with flip-out windshield of this invention.

FIG. 8 shows the second embodiment of this invention. In this embodiment the windshield 100 is provided with a cam 111 fixed at the lower, rear corner between the two side panels 102 where the hole 101A for hinge pin 101 is formed, and in the meantime a spring loaded plunger 211 is provided in the rear, upper portion of the casing 202 of the cigarette lighter body. The axis of said spring loaded plunger 211 is slightly off inwardly from the vertical center line of the hinge pin 101 as indicated by e in FIG. 8, and said cam 111 is designed to cooperate with the spring loaded plunger to constantly urge the windshield to rotate upwardly around the hinge pin 101. It is to be noted that the spring loaded plunger 211 is so provided to give sufficient clearance between itseld and the side panels 205 of the casing 202 so that the movement of the side panels 102 of the windshield will not be blocked.

In the meantime a catch device 212 having tapered points 213 on top is disposed at the inner side of the front panel 204 of the casing 202, said catch device 212 being arranged to ride on a coil spring 215 so that it is always urged upwardly, and a knob 214 protruding outwardly through the slot 207 provided in the front panel 204 of the casing 202.

A hook 121 is formed at a suitable position on the front edge of the two side panels 102 of the windshield 100 to cooperate with aforesaid catch device 212. It is so arranged that, when the windshield 100 is folded in, the catch device 212 latches the hooks 121 to hold the windshield in place. By simply depressing the push button 214 downwardly, the windshield 100 will be released to "flip-out" by the force of aforesaid spring loaded plunger 211.

In the second embodiment as described above the lighting button 302 (or lighting wheel 303 in case of a lighting stone construction) can be arranged at the lower part of one side of the lighter body as shown with imaginary lines in FIG. 8.

Figure 9:
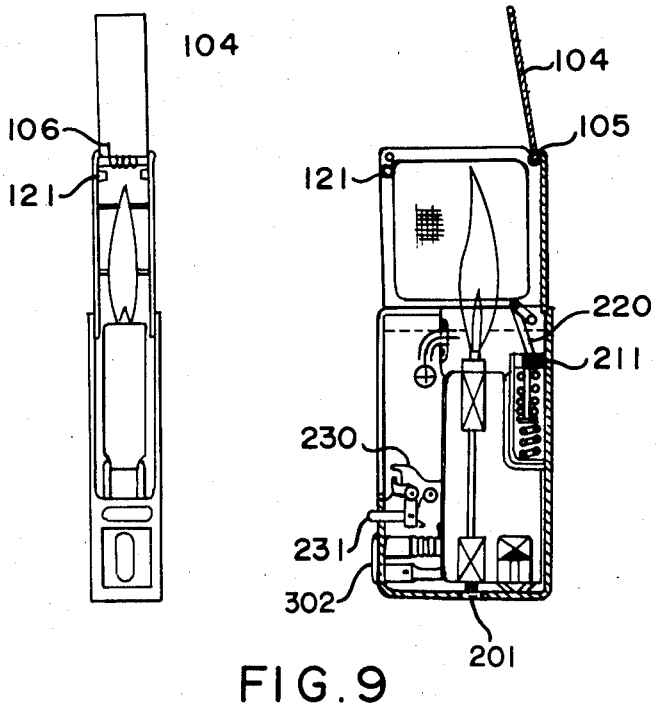
FIG. 9, shows vertical, cross sectional views of the third embodiment of this cigarette lighter with flip-out windshield of this invention.

FIG. 9 shows the third embodiment of this invention. In this embodiment the cam 111 in the second embodiment as shown in FIG. 8 is replaced with a linkage 220, and a spring loaded bell-crank type catch device 230 with a release button 231 is employed. The function and operation of the linkage 220 and the catch device 230 of this embodiment is the same as the cam 111 and the catch device 212 of the second embodiment.

FIGS. 10 and 11 show the fourth embodiment of this invention. This embodiment illustrates a possibility of installing the flip-out windshield of this invention onto a cigarette lighter in which the flaming device is arranged traversely instead of longitudinally. The windshield 100 is then hinged onto the middle portion of the upper side (i.e., rear side in the previous embodiment) of the casing. It is to be understood that slight change in the related parts such as cam or linkage, catch device etc. is needed, but the change is only needed in their relative positions with respect to the windshield or the casing, and the cam or linkage, the spring loaded plunger and the catch device as proposed in the previous embodiment can equally be employed in this embodiment.

It is also to be noted that the lighting button 302 is preferrably arranged at one side of the lighter body.

FIGS. 12 and 13 show the fifth embodiment of this invention. In this embodiment an opening 112 through the rear panel 103 of the flip-out windshield and a sliding cover 113 capable of sliding along the rear panel 103 to cover and uncover said opening 112 are provided. The opening 112 is arranged to allow the flame to extend therethrough when the windshield is folded in with the cover 113 moved to uncover the opening 112. This gives an option of the use of the cigarette lighter with flip-out windshield of this invention without flipping out the windshield.

While there have been shown and described the preferred embodiments of the present invention, it will be understood that the invention may be embodied otherwise than as illustrated or described above and that within said embodiments certain changes in the detail and construction may be made without departing from the spirit and principles of this invention within the scope of the appended claims.

I claim:

1. A cigarette lighter with flip-out windshield comprising a conventional lighting device including a fuel tank, lighting mechanism and a flaming tip, a casing in which said conventional lighting device is accommodated, characterized in having a windshield formed of two symetrically opposing side panels, a rear panel fixedly connecting said side panels, a top lid with its rear edge hinged to each of two upper rear corners of said opposing two side panels, said opposing two side panels being hinged at the lower, rear corners to said casing with a hinge pin and being capable of rotating around said hinge pin to move in and out of clearance provided between said conventional lighting device and said casing.

2. A cigarette lighter with flip-out windshield according to claim 1, wherein said side panels of said windshield each consists of a rectangular metallic frame with a fine mesh metallic wire screen stretched therein.

3. A cigarette lighter with flip-out windshield according to claim 1, wherein said windshield is provided with a cam at the corner between said two side opposing side panels where it is hinged to the casing of said lighter body; said lighter body having a spring loaded plunger with the axis slightly off inwardly from the vertical center line of said hinge pin, the top of said spring loaded plunger abuting on and urging said cam upwardly, said lighter body also being provided with a catch device riding on a spring at a suitable place inside the front panel of said casing, said catch device being cooperable with a hook means provided at a suitable position on the windshield to latch the windshield when it is folded in, and to release the windshield when said catch device is depressed downwardly with a knob provided therewith and protruding outwardly through the front panel of said casing.

4. A cigarette lighter with flip-out windshield according to claim 1, wherein said lighter body is provided with a spring loaded plunger connected to said windshield with a linkage, said spring loaded plunger being capable of urging said windshield to flip-out; said lighter body is provided with a catch device having a spring loaded bell-crank at a suitable place inside the front panel of said casing, said catch device being cooperable with a hook means provided at a suitable position on the windshield to latch the windshield when it is folded in, and to release the windshield when said catch device is depressed with a button provided therewith and protruding outwardly through the front panel of said casing.

5. A cigarette lighter with flip-out windshield according to claim 1, wherein the rear panel of said windshield is provided with an opening and a sliding cover capable of sliding along said rear panel to cover and uncover said opening.

* * * * *